US011819081B1

(12) United States Patent
Bullocks-Fox

(10) Patent No.: US 11,819,081 B1
(45) Date of Patent: Nov. 21, 2023

(54) SHOWER CAP ASSEMBLY

(71) Applicant: Brenda Bullocks-Fox, Indianapolis, IN (US)

(72) Inventor: Brenda Bullocks-Fox, Indianapolis, IN (US)

( * ) Notice: Subject to any disclaimer, the term of this patent is extended or adjusted under 35 U.S.C. 154(b) by 2 days.

(21) Appl. No.: 17/845,623

(22) Filed: Jun. 21, 2022

(51) Int. Cl.
*A45D 19/14* (2006.01)
*A42B 1/12* (2006.01)

(52) U.S. Cl.
CPC ..... *A42B 1/12* (2013.01); *A45D 19/14* (2013.01)

(58) Field of Classification Search
CPC ..... A45D 19/04; A45D 19/12; A45D 19/06; A42B 1/12
USPC ..... 4/515
See application file for complete search history.

(56) References Cited

U.S. PATENT DOCUMENTS 2,600,557 A * 6/1952 Marriott ..... A45D 2/46 132/212
2,637,853 A * 5/1953 Rochlin ..... A45D 20/42 224/186
2,850,742 A 9/1958 Glintz
3,456,655 A 7/1969 Hale
3,996,946 A * 12/1976 Craig ..... A45D 19/10 132/212
4,361,158 A 11/1982 Baker
D302,340 S 7/1989 Rasmussen
5,099,865 A 3/1992 Flannery
6,728,977 B1 5/2004 Knight
D630,796 S * 1/2011 Bass ..... D28/20
10,463,550 B1 11/2019 Shekarchi

FOREIGN PATENT DOCUMENTS

WO WO2016140461 9/2016

* cited by examiner

*Primary Examiner* — Huyen D Le

(57) ABSTRACT

A shower cap assembly includes a shower cap that is wearable on a user's head. The shower cap has a water opening extending through the shower cap to facilitate water to be poured onto the user's head when the shower cap is being worn. A water hose is fluidly attached to the shower cap to drain the water poured into the shower cap for washing the user's hair. A bucket provided which is in fluid communication with the water hose to receive the water which drains from the shower cap. A lid is hingedly coupled to the bucket and a hose aperture extends through the lid to facilitate the water hose to be extended through the hose aperture when the lid is closed. A handle is coupled to the lid such that the handle can be gripped for opening and closing the lid.

12 Claims, 3 Drawing Sheets

SHOWER CAP ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) FIELD OF THE INVENTION

The disclosure relates to shower devices and more particularly pertains to a new shower device for facilitating a physically disabled user to have their hair washed. The device includes a shower cap with a water opening to facilitate water to be poured onto a user's head when the user wears the shower cap. The device includes a water hose that is attached to the shower cap for draining the water from the shower cap. The device includes a bucket into which the hose can be routed for receiving the water from the water hose. The device additionally includes a lid that is hingedly coupled to the bucket which has a hose aperture for routing the water hose through the hose aperture.

(2) Description of Related Art Including Information Disclosed Under 37 CFR 1.97 and 1.98

The prior art relates to shower devices including a portable shampoo cabinet which includes a water pump, a hose coupled to the water pump for pumping water and a tray fluidly coupled to the water pump for returning water to the water pump. The prior art discloses a variety of shower caps which each includes a shower head integrated into the shower cap and a drain hose integrated into the shower cap. The shower head can be fluidly coupled to a faucet of a sink and the drain hose can be placed into the sink. The prior art discloses a shower hood which is positionable around a user's head, an opening into the shower hood for receiving water and a drain sock integrated into the shower hood for capturing the water. The prior art discloses a hair washing device that includes an inclined ramp upon which a user can lie, a shower hood that is positionable to enclose the user's head and a drain container. The prior art discloses an ornamental design for a shower sock which includes a water hose integrated into the shower sock.

(h) BRIEF SUMMARY OF THE INVENTION

An embodiment of the disclosure meets the needs presented above by generally comprising a shower cap that is wearable on a user's head. The shower cap has a water opening extending through the shower cap to facilitate water to be poured onto the user's head when the shower cap is being worn. A water hose is fluidly attached to the shower cap to drain the water poured into the shower cap for washing the user's hair. A bucket provided which is in fluid communication with the water hose to receive the water which drains from the shower cap. A lid is hingedly coupled to the bucket and a hose aperture extends through the lid to facilitate the water hose to be extended through the hose aperture when the lid is closed. A handle is coupled to the lid such that the handle can be gripped for opening and closing the lid.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
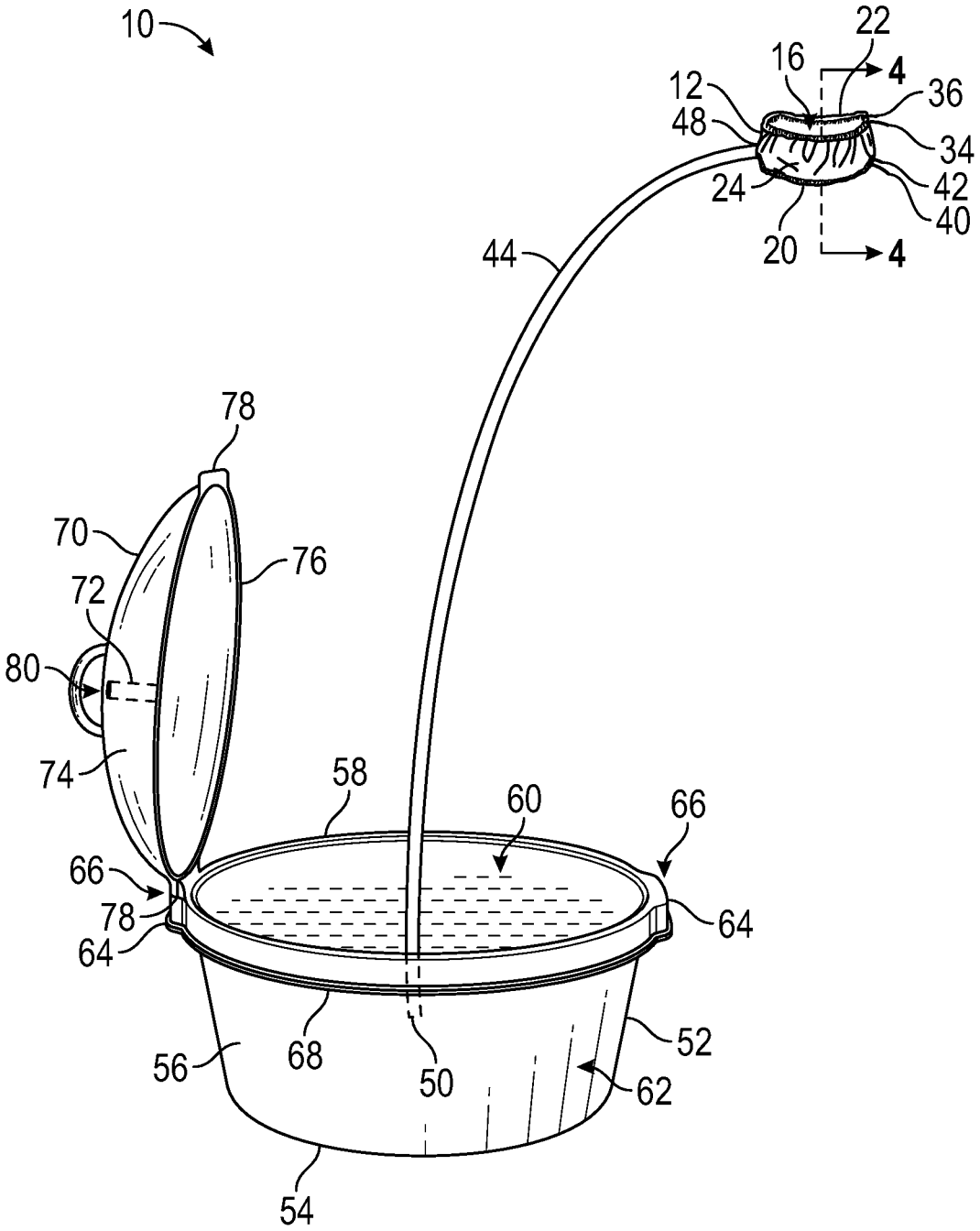
FIG. 1 is a perspective view of a shower cap assembly according to an embodiment of the disclosure.
Figure 2:
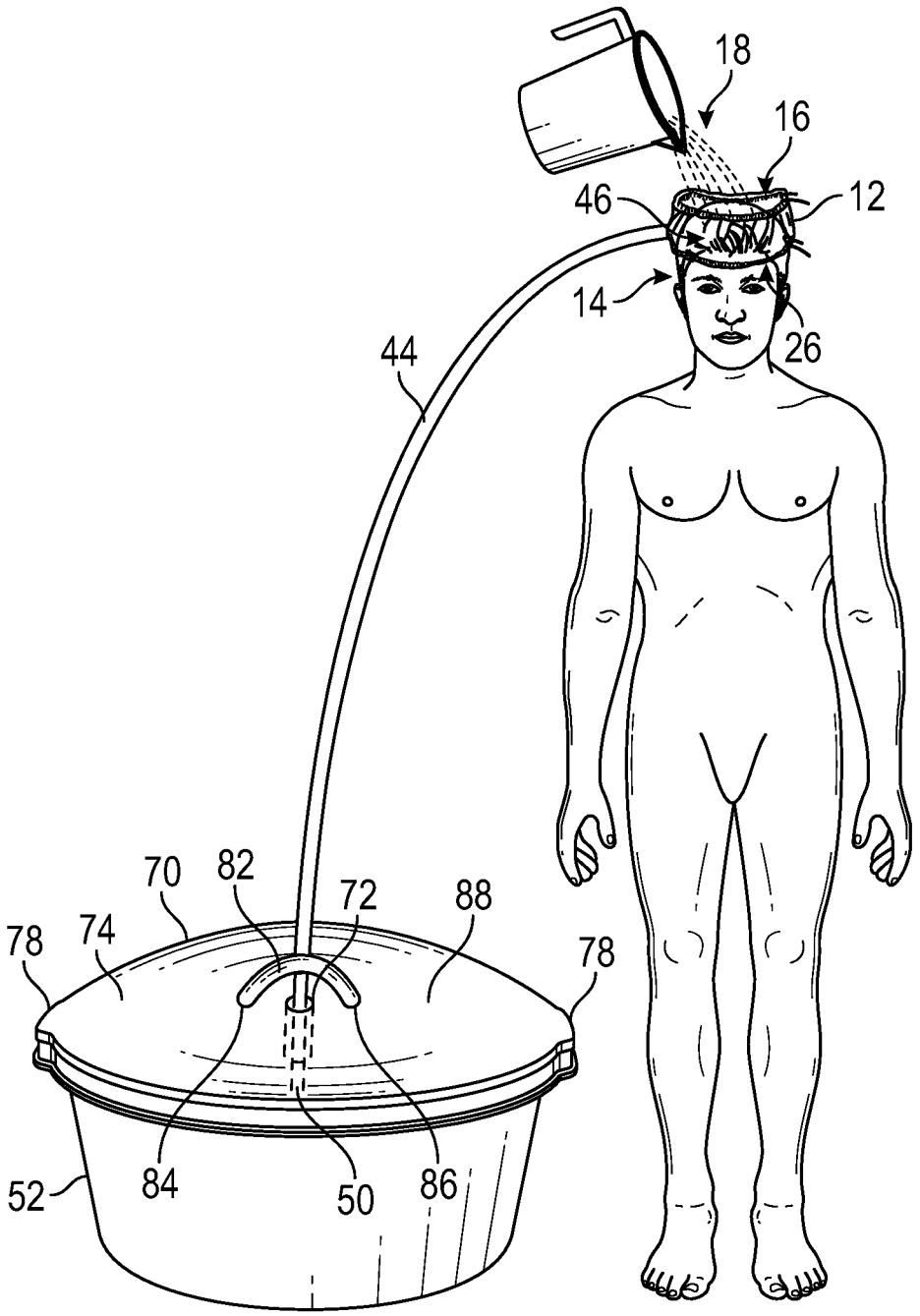
FIG. 2 is a perspective in-use view of an embodiment of the disclosure.
Figure 3:
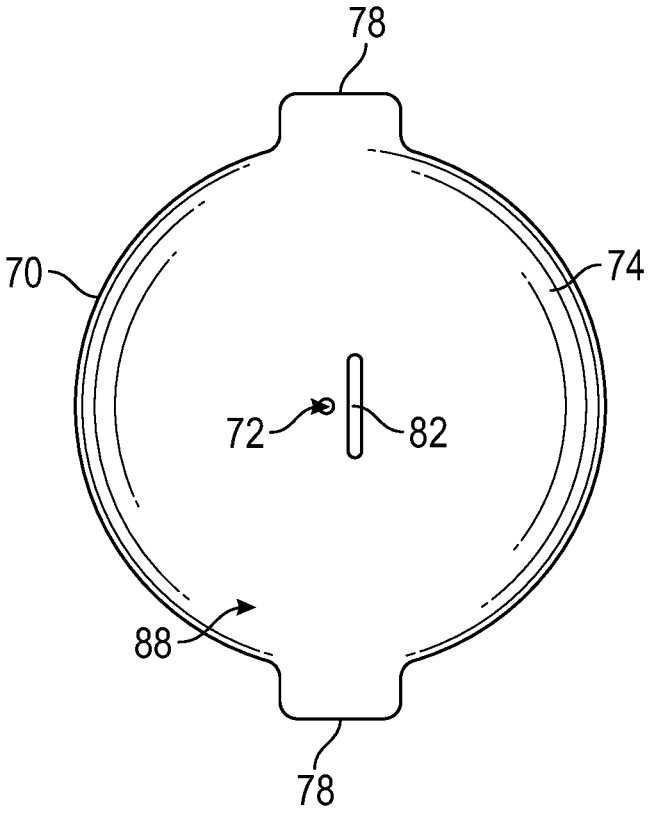
FIG. 3 is a top view of a lid of an embodiment of the disclosure.
Figure 4:
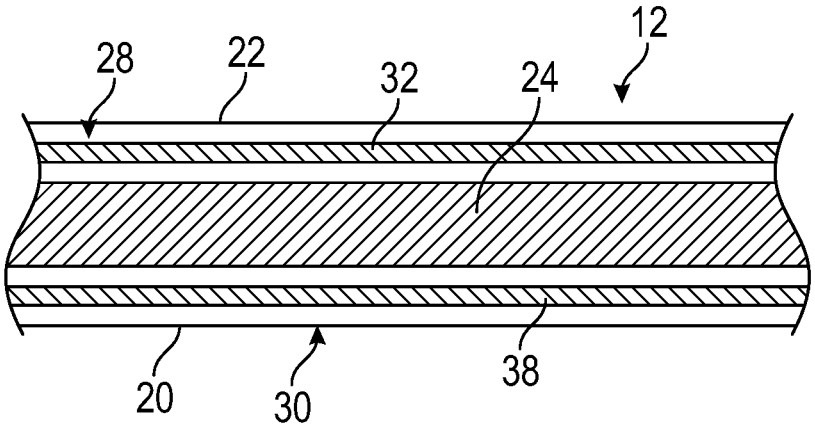
FIG. 4 is a cross sectional view taken along line 4-4 of FIG. 1 of an embodiment of the disclosure.

With reference now to the drawings, and in particular to FIGS. 1 through 4 thereof, a new shower device embodying the principles and concepts of an embodiment of the disclosure and generally designated by the reference numeral 10 will be described.

As best illustrated in FIGS. 1 through 4, the shower cap assembly 10 generally comprises a shower cap 12 that is wearable on a user's head 14. The shower cap 12 has a water opening 16 extending through the shower cap 12 to facilitate water 18 to be poured onto the user's head 14 when the shower cap 12 is being worn. The shower cap 12 has a bottom edge 20, a top edge 22 and an outer wall 24 extending between the top edge 22 and the bottom edge 20. The outer wall 24 is continuously arcuate about an axis extending between the top edge 22 and the bottom edge 20 such that the shower cap 12 has a cylindrical shape. Furthermore, the bottom edge 20 defines a head opening 26 in the shower cap 12 to receive the user's head 14 and the top edge 22 defines the water opening 16 in the shower cap 12. The shower cap 12 is comprised of a fluid impermeable material to inhibit the water from passing through the shower cap 12.

The shower cap 12 has a first channel 28 that is integrated into the outer wall 24, and the first channel 28 is aligned with and is coextensive with the top edge 22. The shower cap 12 has a second channel 30 which is integrated into the outer wall 24 and the second channel 30 is aligned with and is coextensive with the bottom edge 20. The user may be a physically disabled person, an elderly person or other person that is not only incapable of bathing themselves, but is also not capable of leaning forward or backward. Thus, the user must remain in an upright position, whether seated or standing, and the user requires assistance with washing their hair 46.

A first drawstring 32 is movably integrated into the shower cap 12 and the first drawstring 32 is aligned with the water opening 16 thereby facilitating the first drawstring 32 to open or close the water opening 16. The first drawstring 32 is positioned inside the first channel 28, and the first drawstring 32 has a first end 34 and a second end 36. Each of the first end 34 and the second end 36 extends outwardly through the outer wall 24 of the shower cap 12 such that each of the first end 34 and the second end 36 are exposed for tightening the first drawstring 32. A second drawstring 38 is movably integrated into the shower cap 12 and the second drawstring 38 is aligned with the water opening 16 thereby facilitating the second drawstring 38 to open or close the water opening 16. The second drawstring 38 is positioned inside the second channel 30, and the second drawstring 38 has a first end 40 and a second end 42. Each of the first end 40 and the second end 42 of the second drawstring 38 extends outwardly through the outer wall 24 of the shower cap 12 such that each of the first end 40 and the second end 42 of the second drawstring 38 are exposed for tightening the second drawstring 38.

A water hose 44 is fluidly attached to the shower cap 12 to facilitate the water hose 44 to drain the water 18 poured into the shower cap 12 for washing the user's hair 46. The water hose 44 has a primary end 48 and a secondary end 50, and the primary end 48 extends through the outer wall 24 of the shower cap 12 at a point that is located between the top edge 22 and the bottom edge 20. The water hose 44 may have a length of at least 48.0 inches and the water hose 44 is comprised of a flexible material, including but not being limited rubber or silicone, to facilitate the water hose 44 to be routed in a preferred direction.

A bucket 52 is provided and the bucket 52 is in fluid communication with the water hose 44 to receive the water 18 which drains from the shower cap 12. The bucket 52 has a bottom wall 54 and an outer wall 56 extending upwardly from the bottom wall 54, and the outer wall 56 of the bucket 52 has a distal edge 58 with respect to the bottom wall 54 defining an opening 60 into the bucket 52. The outer wall 56 of the bucket 52 has an outer surface 62 and the outer wall 56 of the bucket 52 has a pair of protrusions 64 each extending outwardly from the outer surface 62 to define a pair of handles 66 for gripping. Each of the protrusions 64 is positioned on opposite sides of the outer wall 56 of the bucket 52 from each other and each of the protrusions 64 is aligned with the distal edge 58. The outer wall 56 of the bucket 52 has a lip 68 extending outwardly from the outer surface 62, and the lip 68 is spaced downwardly from the distal edge 58 and the lip 68 extends around a full circumference of the outer wall 24.

A lid 70 is provided which is hingedly coupled to the bucket 52 and the lid 70 has a hose aperture 72 extending through the lid 70 to facilitate the water hose 44 to be extended through the hose aperture 72 when the lid 70 is closed. The lid 70 has an exterior wall 74 and a bottom edge 76, and the exterior wall 74 is convexly arcuate with respect to the bottom edge 76 of the lid 70. The exterior wall 74 has a pair of protruded sections 78 each extending outwardly from the lid 70 at a point that is aligned with the bottom edge 20 of the lid 70. The protruded sections 78 are positioned on opposite sides of the lid 70 from each other. Additionally, the bottom edge 20 of the lid 70 associated with a respective one of the protruded sections 78 hingedly engages the distal edge 58 of the outer wall 24 of the bucket 52 at a point aligned with a respective one of the protrusions 64 on the outer wall 24 of the bucket 52.

Each of the protruded sections 78 rests on the respective protrusions 64 in the outer wall 24 of the bucket 52 when the lid 70 is closed. The hose aperture 72 extends through the exterior wall 74 and the hose aperture 72 is offset from an apex 80 of the exterior wall 74. The secondary end 50 of the water hose 44 is positioned inside the bucket 52 when the water hose 44 is extended through the hose aperture 72. A handle 82 is coupled to the lid 70 such that the handle 82 can be gripped for opening and closing the lid 70. The handle 82 has a first end 84 and a second end 86, and the handle 82 is curved between the first end 84 and the second end 86 of the handle 82. Each of the first end 84 and the second end 86 of the handle 82 is coupled to a top surface 88 of the exterior wall 74 of the lid 70 and the handle 82 is aligned with the apex 80 of the exterior wall 74.

In use, the shower cap 12 is positioned around the user's head 14 and each of the first drawstring 32 and the second drawstring 38 are tightened to achieve a preferred fitment of the shower cap 12 on the user's head 14. The water hose 44 is either inserted directly into the bucket 52 when the lid 70 is opened, or the water hose 44 is inserted through the hose aperture 72 in the lid 70 when the lid 70 is closed, depending on the user's preference. Water 18 is poured into the water opening 16 in the shower cap 12 to facilitate the user's hair 46 to be washed. Furthermore, the water 18 drains through the water hose 44 and into the bucket 52 for collection. The shower cap 12 is removed from the user's head 14 when the user's hair 46 is finished being washed and rinsed.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A shower cap assembly for facilitating a person to shampoo their hair while seated in an upright position without being seated in a bathtub, said assembly comprising:

a shower cap being wearable on a user's head, said shower cap having a water opening extending through said shower cap wherein said water opening is configured to facilitate water to be poured onto the user's head when said shower cap is being worn;

a first drawstring being movably integrated into said shower cap, said first drawstring being aligned with said water opening thereby facilitating said first drawstring to open or close said water opening;

a second drawstring being movably integrated into said shower cap, said second drawstring being aligned with said water opening thereby facilitating said second drawstring to open or close said water opening;

a water hose being fluidly attached to said shower cap wherein said water hose is configured to drain the water poured into said shower cap for washing the user's hair;

a bucket being in fluid communication with said water hose wherein said bucket is configured to receive the water which drains from said shower cap;

a lid being hingedly coupled to said bucket, said lid having a hose aperture extending through said lid to facilitate said water hose to be extended through said hose aperture when said lid is closed; and a handle being coupled to said lid such that said handle can be gripped for opening and closing said lid.

2. The assembly according to claim 1, wherein said shower cap has a bottom edge, a top edge and an outer wall extending between said top edge and said bottom edge, said outer wall being continuously arcuate about an axis extending between said top edge and said bottom edge such that said shower cap has a cylindrical shape, said bottom edge defining a head opening in said shower cap wherein said bottom opening is configured to receive the user's head, said top edge defining said water opening in said shower cap.

3. The assembly according to claim 2, wherein said shower cap has a first channel being integrated into said outer wall, said first channel being aligned with and being coextensive with said top edge.

4. The assembly according to claim 3, wherein said shower cap has a second channel being integrated into said outer wall, said second channel being aligned with and being coextensive with said bottom edge.

5. The assembly according to claim 3, wherein said first drawstring is positioned inside said first channel, said first drawstring having a first end and a second end, each of said first end and said second end extending outwardly through said outer wall of said shower cap such that each of said first end and said second end are exposed for tightening said first drawstring.

6. The assembly according to claim 4, wherein said second drawstring is positioned inside said second channel, said second drawstring having a first end and a second end, each of said first end and said second end of said second drawstring extending outwardly through said outer wall of said shower cap such that each of said first end and said second end of said second drawstring are exposed for tightening said second drawstring.

7. The assembly according to claim 2, wherein said shower cap is comprised of a fluid impermeable material wherein said shower cap is configured to inhibit the water from passing through said shower cap.

8. The assembly according to claim 2, wherein said water hose has a primary end and a secondary end, said primary end extending through said outer wall of said shower cap at a point being located between said top edge and said bottom edge.

9. The assembly according to claim 1, wherein:

said bucket has a bottom wall and an outer wall extending upwardly from said bottom wall, said outer wall having a distal edge with respect to said bottom wall defining an opening into said bucket, said outer wall having an outer surface;

said outer wall has a pair of protrusions each extending outwardly from said outer surface to define a pair of handles for gripping, each of said protrusions being positioned on opposite sides of said outer wall from each other, each of said protrusions being aligned with said distal edge; and said outer wall has a lip extending outwardly from said outer surface, said lip being spaced downwardly from said distal edge, said lip extending around a full circumference of said outer wall.

10. The assembly according to claim 9, wherein:

said lid has an exterior wall and a bottom edge, said exterior wall being convexly arcuate with respect to said bottom edge of said lid;

said exterior wall has a pair of protruded sections each extending outwardly from said lid at a point being aligned with said bottom edge of said lid, said protruded sections being positioned on opposite sides of said lid from each other;

said bottom edge of said lid associated with a respective one of said protruded sections hingedly engages said distal edge of said outer wall of said bucket at a point aligned with a respective one of said protrusions on said outer wall of said bucket;

each of said protruded sections rests on said respective protrusions in said outer wall of said bucket when said lid is closed; and said hose aperture extends through said exterior wall, said hose aperture being offset from said apex of said exterior wall.

11. The assembly according to claim 10, wherein said handle has a first end and a second end, said handle being curved between said first end and said second end of said handle, each of said first end and said second end of said handle being coupled to a top surface of said exterior wall of said lid, said handle being aligned with said apex of said exterior wall.

12. A shower cap assembly for facilitating a person to shampoo their hair while seated in an upright position without being seated in a bathtub, said assembly comprising:

a shower cap being wearable on a user's head, said shower cap having a water opening extending through said shower cap wherein said water opening is configured to facilitate water to be poured onto the user's head when said shower cap is being worn, said shower cap having a bottom edge, a top edge and an outer wall extending between said top edge and said bottom edge, said outer wall being continuously arcuate about an axis extending between said top edge and said bottom edge such that said shower cap has a cylindrical shape, said bottom edge defining a head opening in said shower cap wherein said bottom opening is configured to receive the user's head, said top edge defining said water opening in said shower cap, said shower cap having a first channel being integrated into said outer wall, said first channel being aligned with and being coextensive with said top edge, said shower cap having a second channel being integrated into said outer wall, said second channel being aligned with and being coextensive with said bottom edge, said shower cap being comprised of a fluid impermeable material wherein said shower cap is configured to inhibit the water from passing through said shower cap;

a first drawstring being movably integrated into said shower cap, said first drawstring being aligned with said water opening thereby facilitating said first drawstring to open or close said water opening, said first drawstring being positioned inside said first channel, said first drawstring having a first end and a second end, each of said first end and said second end extending outwardly through said outer wall of said shower cap such that each of said first end and said second end are exposed for tightening said first drawstring;

a second drawstring being movably integrated into said shower cap, said second drawstring being aligned with said water opening thereby facilitating said second drawstring to open or close said water opening, said second drawstring being positioned inside said second channel, said second drawstring having a first end and a second end, each of said first end and said second end of said second drawstring extending outwardly through said outer wall of said shower cap such that each of said first end and said second end of said second drawstring are exposed for tightening said second drawstring;

a water hose being fluidly attached to said shower cap wherein said water hose is configured to drain the water poured into said shower cap for washing the user's hair, said water hose having a primary end and a secondary end, said primary end extending through said outer wall of said shower cap at a point being located between said top edge and said bottom edge;

a bucket being in fluid communication with said water hose wherein said bucket is configured to receive the water which drains from said shower cap, said bucket having a bottom wall and an outer wall extending upwardly from said bottom wall, said outer wall of said bucket having a distal edge with respect to said bottom wall defining an opening into said bucket, said outer wall of said bucket having an outer surface, said outer wall of said bucket having a pair of protrusions each extending outwardly from said outer surface to define a pair of handles for gripping, each of said protrusions being positioned on opposite sides of said outer wall of said bucket from each other, each of said protrusions being aligned with said distal edge, said outer wall of said bucket having a lip extending outwardly from said outer surface, said lip being spaced downwardly from said distal edge, said lip extending around a full circumference of said outer wall of said bucket;

a lid being hingedly coupled to said bucket, said lid having a hose aperture extending through said lid to facilitate said water hose to be extended through said hose aperture when said lid is closed, said lid having an exterior wall and a bottom edge, said exterior wall being convexly arcuate with respect to said bottom edge of said lid, said exterior wall having a pair of protruded sections each extending outwardly from said lid at a point being aligned with said bottom edge of said lid, said protruded sections being positioned on opposite sides of said lid from each other, said bottom edge of said lid associated with a respective one of said protruded sections hingedly engaging said distal edge of said outer wall of said bucket at a point aligned with a respective one of said protrusions on said outer wall of said bucket, each of said protruded sections resting on said respective protrusions in said outer wall of said bucket when said lid is closed, said hose aperture extending through said exterior wall, said hose aperture being offset from said apex of said exterior wall, said secondary end of said water hose being positioned inside said bucket when said water hose is extended through said hose aperture; and a handle being coupled to said lid such that said handle can be gripped for opening and closing said lid, said handle having a first end and a second end, said handle being curved between said first end and said second end of said handle, each of said first end and said second end of said handle being coupled to a top surface of said exterior wall of said lid, said handle being aligned with said apex of said exterior wall.

* * * * *